US010086970B2

(12) United States Patent
Gutekunst et al.

(10) Patent No.: US 10,086,970 B2
(45) Date of Patent: Oct. 2, 2018

(54) PACKAGE

(71) Applicant: Berry Plastics Corporation, Evansville, IN (US)

(72) Inventors: Brady Gutekunst, Anaheim, CA (US); Donald H Ankney, Ellicott City, MD (US); Joseph J Bruchman, Lancaster, PA (US); Jerry Gordon, Millersville, PA (US)

(73) Assignee: Berry Plastics Corporation, Evansville, IN (US)

( * ) Notice: Subject to any disclaimer, the term of this patent is extended or adjusted under 35 U.S.C. 154(b) by 205 days.

(21) Appl. No.: 14/969,386

(22) Filed: Dec. 15, 2015

(65) Prior Publication Data

US 2016/0167823 A1 Jun. 16, 2016

Related U.S. Application Data

(60) Provisional application No. 62/092,083, filed on Dec. 15, 2014.

(51) Int. Cl.

| | |
|---|---|
| ***B65D 90/02*** | (2006.01) |
| ***B65D 1/02*** | (2006.01) |
| ***B65D 79/00*** | (2006.01) |

(52) U.S. Cl.

CPC ..... *B65D 1/0223* (2013.01); *B65D 79/005* (2013.01); *B65D 2501/0036* (2013.01)

(58) Field of Classification Search

CPC ..... B65D 1/0223; B65D 79/005; B65D 2501/0036

USPC ..... 215/382, 383, 384

See application file for complete search history.

(56) References Cited

U.S. PATENT DOCUMENTS

| | | | | |
|---|---|---|---|---|
| 4,863,046 | A * | 9/1989 | Collette | B29C 49/0073 215/381 |
| 5,178,289 | A | 1/1993 | Krishnakumar et al. | |
| 5,704,504 | A * | 1/1998 | Bueno | B65D 1/0223 215/381 |
| 5,908,128 | A * | 6/1999 | Krishnakumar | B65D 1/0223 215/381 |
| 6,036,037 | A | 3/2000 | Scheffer et al. | |
| 6,062,409 | A * | 5/2000 | Eberle | B65D 1/0223 215/381 |
| 6,228,317 | B1 | 5/2001 | Smith et al. | |
| 6,575,320 | B2 * | 6/2003 | Ota | B65D 1/0223 215/381 |
| 6,585,125 | B1 * | 7/2003 | Peek | B65D 1/0223 215/381 |
| 7,063,222 | B2 * | 6/2006 | Sakaguchi | B29C 47/0023 215/379 |
| 7,137,520 | B1 * | 11/2006 | Melrose | B65D 1/0223 215/381 |
| 2006/0118508 | A1 | 6/2006 | Kraft et al. | |
| 2006/0147664 | A1 | 7/2006 | Richards et al. | |

(Continued)

OTHER PUBLICATIONS

International Search Report and Written Opinion, Application No. PCT/US2015/065718, dated Feb. 26, 2016.

*Primary Examiner* — J. Gregory Pickett
*Assistant Examiner* — Niki M Eloshway
(74) *Attorney, Agent, or Firm* — Barnes & Thornburg LLP

(57) ABSTRACT

The present disclosure relates to a package including a floor and a side wall extending upwardly from the floor. The package is configured to receive a high-temperature fluid during a container-filling activity at a container-filling factory.

14 Claims, 7 Drawing Sheets

(56) References Cited

U.S. PATENT DOCUMENTS

2006/0175284 A1* 8/2006 Noll ..... B65D 1/0261
215/382
2010/0116777 A1* 5/2010 Ishii ..... B29B 11/14
215/381

* cited by examiner

VERTICAL CENTRAL AXIS
HOT-FILL DISPENSER
COOLING TUNNEL
ATM

PACKAGE

PRIORITY CLAIM

This application claims priority under 35 U.S.C. § 119(e) to U.S. Provisional Application No. 62/092,083, filed Dec. 15, 2014, which is expressly incorporated by reference herein.

BACKGROUND

The present disclosure relates to a package, and in particular to a package including a container and a lid for the container. More particularly, the present disclosure relates to a container that can survive exposure to temperature variations during discharge of hot liquids into the container.

SUMMARY

A package in accordance with the present disclosure includes a lid adapted to mate with the brim of a container to close an opening into an interior product-storage region formed in the container. In illustrative embodiments, the container is configured to be filled with a hot liquid or other fluid at a container-filling factory before the lid is mounted on the brim of the container.

In illustrative embodiments, the container in the package can contract and expand in size without bursting during development of vacuum conditions in the interior product-storage region of the container caused by discharge of high temperature liquid or other fluid into the interior product-storage region at a container-filling factory. The thickness and shape of the side wall of the container is varied in accordance with the present disclosure to allow for such contraction and expansion.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figures 1, 1A, 2, 2A, 3, 3A:
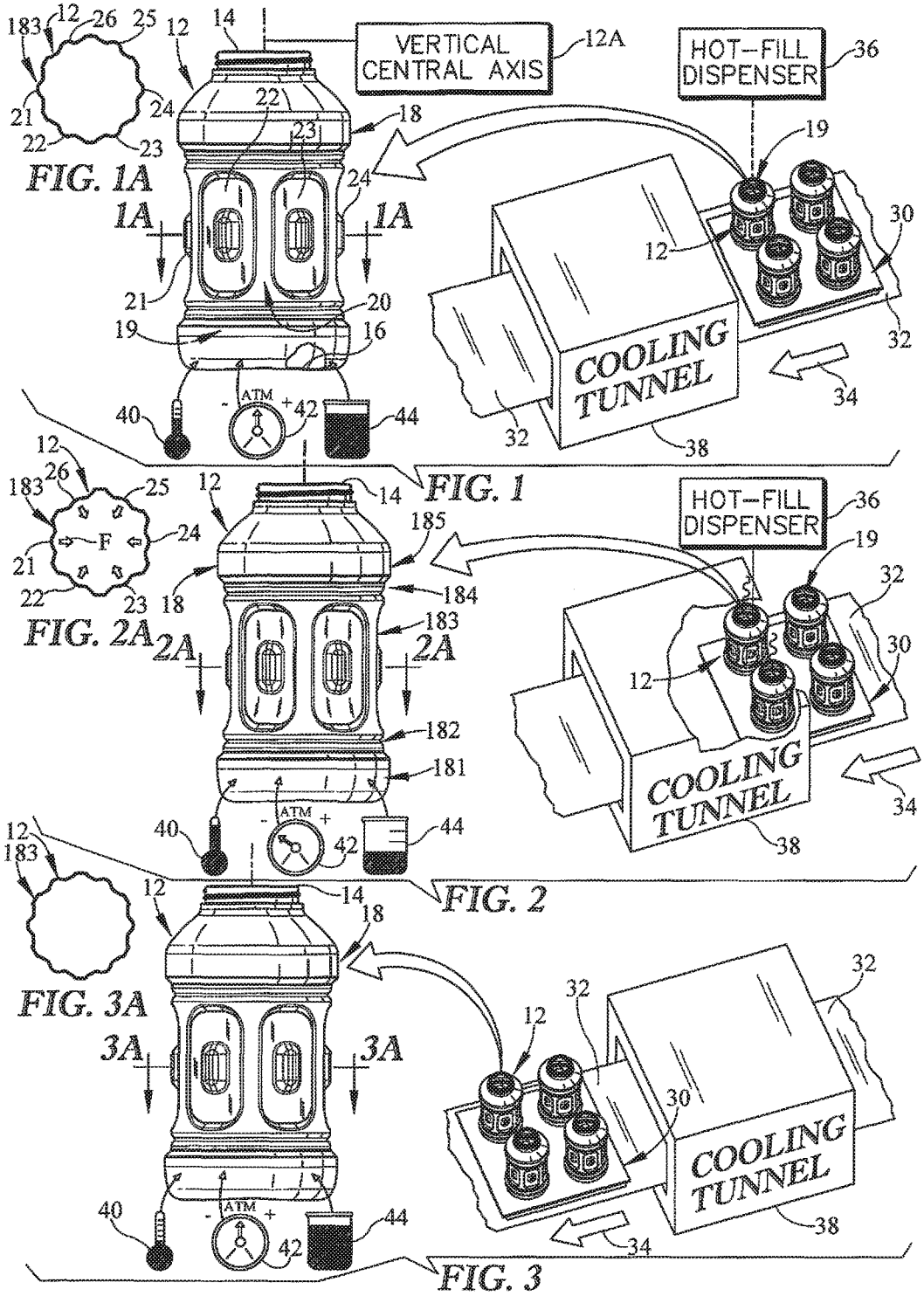
FIG. 1 is a diagrammatic view showing a tray carrying four containers in accordance with the present disclosure and moving along a conveyor past a hot-fill dispenser and toward a cooling tunnel and suggesting that a hot liquid or other fluid can be discharged into an interior product-storage region of each container before the tray passes into the downstream cooling tunnel and suggesting that the container is maintained at room temperature and that the interior product-storage region is maintained at atmospheric pressure and characterized by an initial volume.
FIG. 1A is a reduced-size sectional view taken along line 1A-1A of FIG. 1 showing the normal cross-sectional shape of a middle portion of the side wall of the container when the container is maintained at room temperature and there is no vacuum condition present in the interior product-storage region of the container.
FIG. 2 is a view similar to FIG. 1 showing that the first two containers on the moving tray have been filled with hot liquid or other fluid and the hot liquid has caused a hot-fill vacuum to develop in the interior product-storage region of the container to apply suction forces (represented diagrammatically by several double arrows in FIG. 2A) to the interior surface of the side wall to cause the elastic pop panels included in the side wall of the container to contract in radially inward directions toward a vertical central axis of the container to decrease the volume of the interior product-storage region of the container without damaging the side wall of the container.
FIG. 2A is a reduced-size sectional view taken along line 2A-2A of FIG. 2 showing the contracted cross-sectional shape of the middle portion of the container after each of the six elastic pop panels have contracted in response to exposure to the hot-fill vacuum extant in the interior product-storage region of the container.
FIG. 3 is a view similar to FIGS. 1 and 2 showing that the elastic pop panels included in the side wall of the container have expanded to assume their original pre-contraction shapes after the container was cooled in the cooling tunnel and the pressure in and volume of the interior product-storage region returns to normal.
FIG. 3A is a reduced-size sectional view taken along line 3A-3A of FIG. 3 showing that the elastic middle portion of the side wall of the container has recovered its normal cross-sectional shape.
Figure 10:
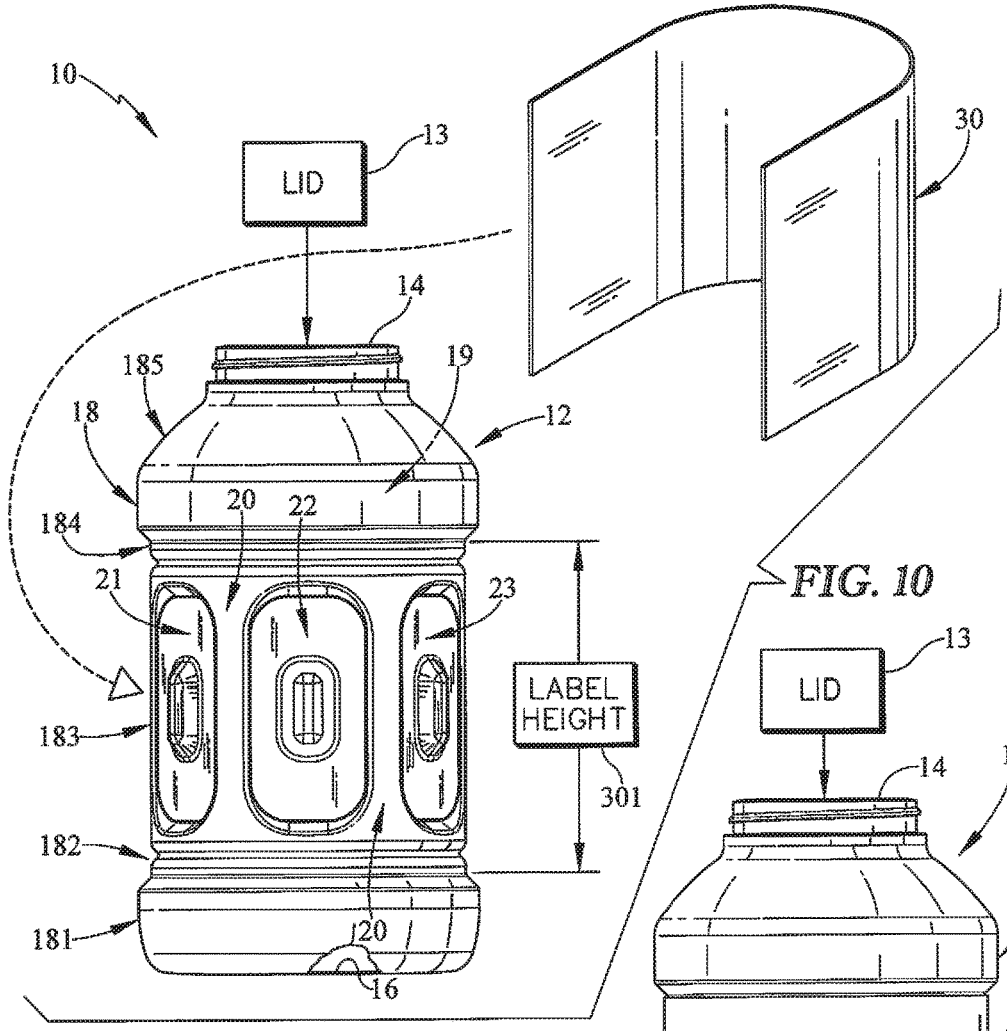
FIG. 10 is an exploded perspective assembly view of a package in accordance with the present disclosure showing the container of FIG. 5, a diagrammatic lid configured to be mounted on a brim of the container, and a pliable sheet adapted to be mated to the side wall of the container to cover the ZONE-2, ZONE-3, and ZONE-4 sections of the side wall as suggested in FIG. 11.
Figure 9:
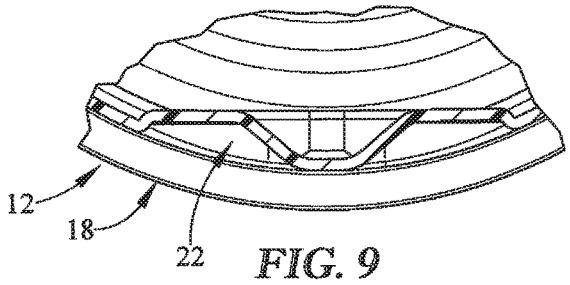
FIG. 9 is a sectional view taken along line 9-9 of FIG. 5.

A package 10 in accordance with the present disclosure includes a container 12 having a brim 14, a floor 16, and a side wall 18 arranged to interconnect brim 14 and floor 16 as suggested in FIG. 1 and a lid 13 for the container 12 as suggested diagrammatically in FIG. 10. In illustrative embodiments, side wall 18 is made of an elastic material that is programmed to flex in a controlled manner during discharge of a high-temperature hot-fill liquid into an interior product-storage region 19 formed in the container 12 and during subsequent cooling of the container 12 to minimize out-of-round distortion of the shape of container 12 as suggested in FIGS. 1-3 and in FIGS. 1A-3A.

Figure 4:
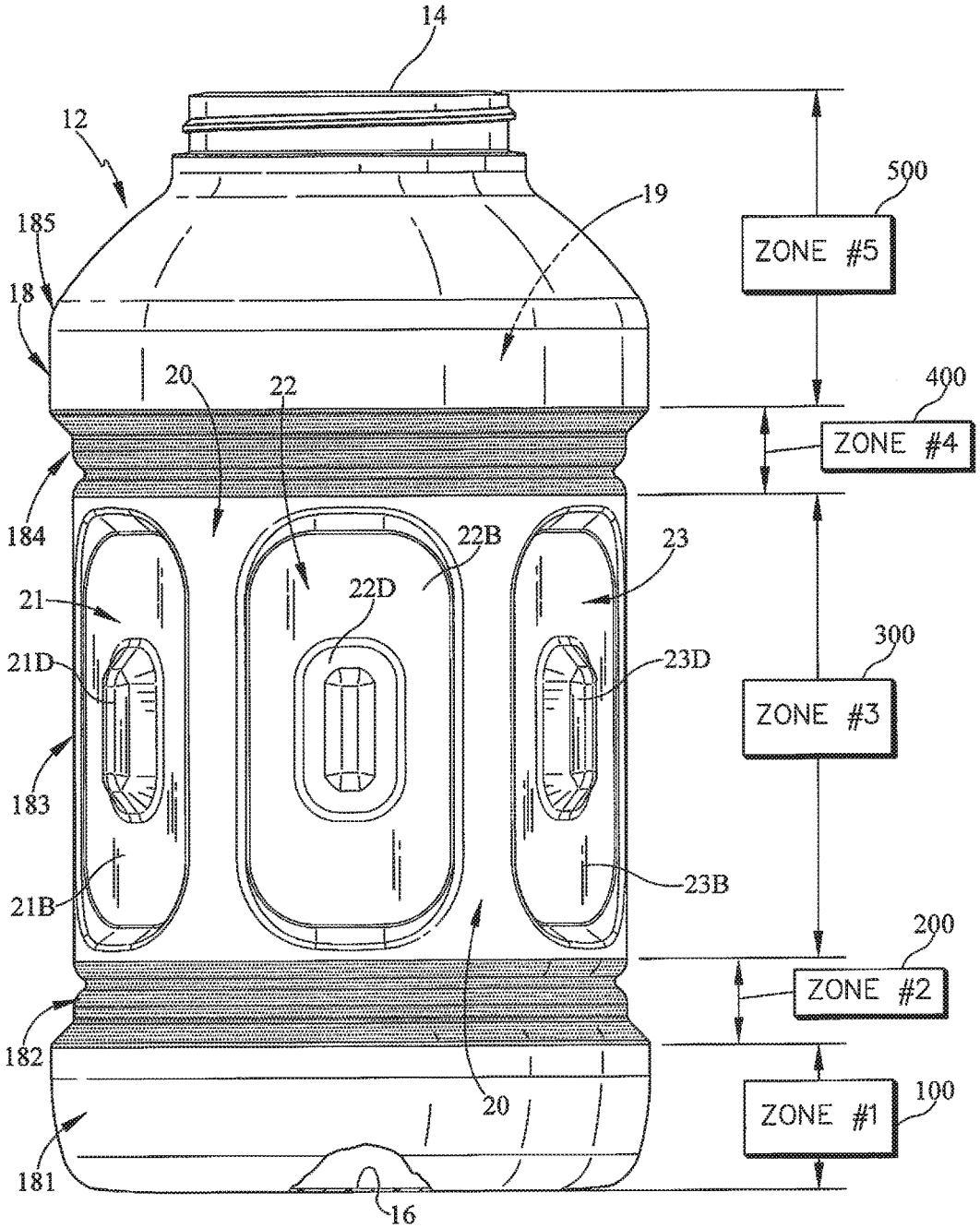
FIG. 4 is an enlarged side elevation view of the container of FIG. 1 taken from a different point of view to show three of the six elastic pop panels included in the side wall of the container and showing that the side wall includes five zones and suggesting that a ZONE-1 section is a lower annular ring coupled to the floor of the container and has a first wall thickness, a ZONE-2 section is a lower annular structural rib coupled to an upper portion of the ZONE-1 section and has a second wall thickness greater than the first wall thickness, a ZONE-3 section is a middle annular ring formed to include several pop panels and coupled to an upper portion of the ZONE-2 section and has a third wall thickness lesser than each of the first and second wall thicknesses, a ZONE-4 section is an upper annular structural rib coupled to an upper portion of the ZONE-3 section and has a fourth wall thickness about equal to the second wall thickness, and a ZONE-5 section is an upper annular ring coupled to an upper portion of the ZONE-4 section and to a brim of the container and has a fifth thickness about equal to the first thickness.
Figure 5:
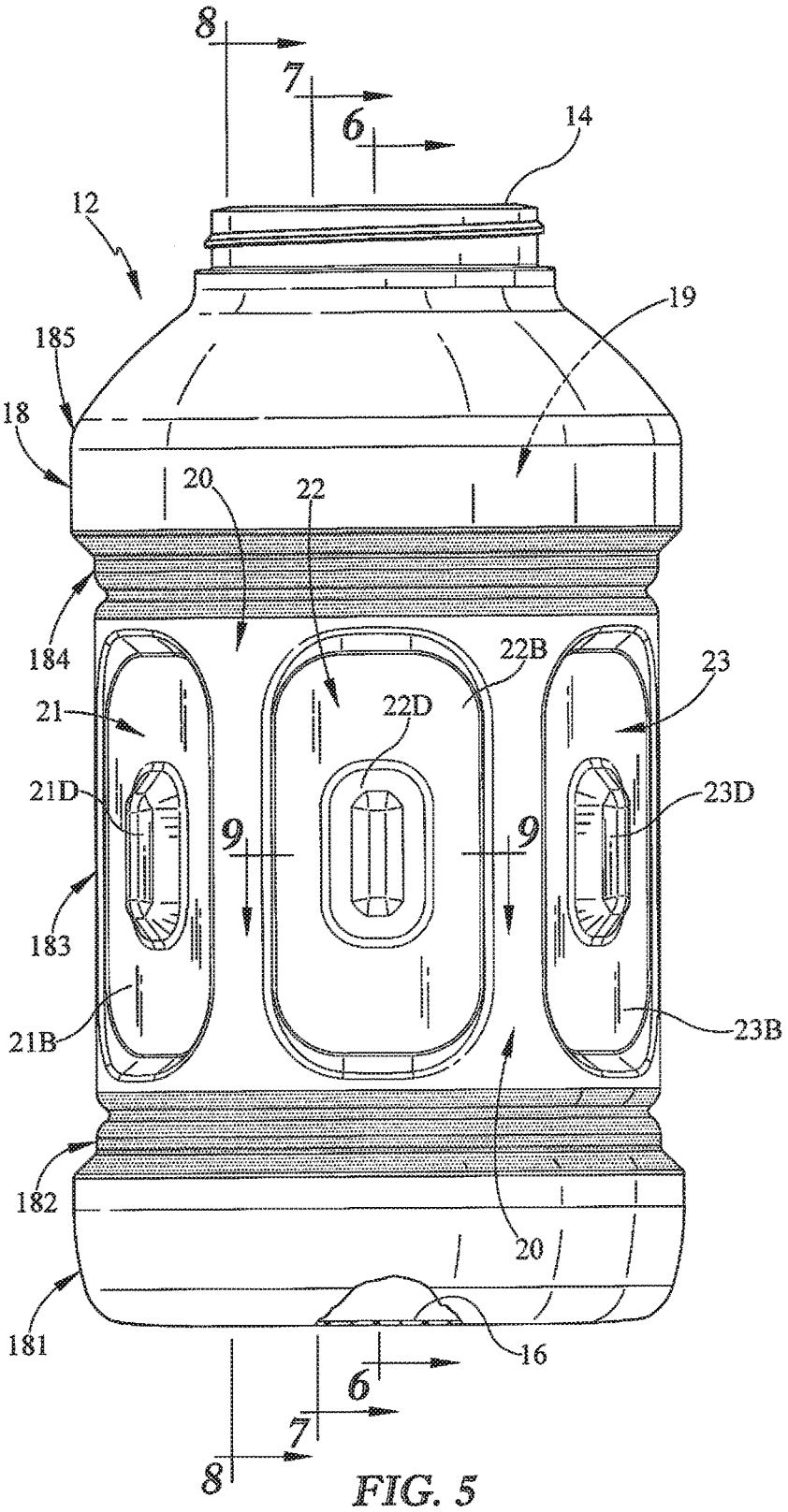
FIG. 5 is a side elevation view similar to FIGS. 1 and 4.

Side wall 18 comprises, in series (bottom to top) a base section 181, a first structural rib section 182, a pop-panel section 183, a second structural rib section 184, and a canopy section 185 as suggested in FIG. 4. These sections 181-185 are configured and sized to cooperate to establish a side wall 18 of a container 12 that has a shape after it is hot-filled that matches the shape it had before it was hot-filled. Container 12 made in accordance with the present disclosure can be hot filled (fill temperature in excess of 190° F.) without unwanted paneling or distortion.

Container 12 is made using a blow-molding process in accordance with the present disclosure. Polypropylene is used in illustrative embodiments. The parison (not shown) used in accordance with the present disclosure is programmed to have varying thicknesses along its length to produce a container 12 having a side wall 18 of varying thickness. Side wall 18 of container 12 has a variable wall thickness as suggested in FIG. 4. Base section 181 defines a first side-wall zone 100 characterized by a wall thickness of about 0.025 inches. First structural rib section 182 defines a second side-wall zone 200 characterized by a wall thickness of about 0.045 inches. Pop-panel section 183 defines a third side-wall zone 300 characterized by a wall thickness of 0.015 inches in which the center of each pop-panel section 183 is the thinner wall target area, blending from the relatively thicker adjacent second and fourth side-wall zones 182, 184. Second structural rib section 184 defines a fourth side-wall zone 400 characterized by a wall thickness of about 0.050 inches. Canopy section 185 defines a fifth side-wall zone 500 characterized by a wall thickness of about 0.025 inches. Side wall 18 is configured in accordance with the present disclosure to avoid transformation to an out-of-round or otherwise distorted shape during hot fill and subsequent cooling activity.

Pop-panel section 183 of side wall 18 of container 12 is formed to include a frame 20 and six elastic pop panels 21-26 as suggested in FIG. 1. Frame 20 is arranged to interconnect an upper edge of first structural rib 182 and a lower edge of second structural rib 184 as suggested in FIG. 4. Frame 20 is formed to include six circumferentially spaced-apart, oblong, endless panel borders as suggested in FIGS. 1, 1A, and 4. Each elastic pop panel 21-26 is coupled to one of those panel borders included in frame 20 to fill the space bounded by that panel border and provide a monolithic third side-wall zone 183. Each elastic pop panel 21-26 is pliable and flexible and comprises a central dome (e.g. 21D) and a ring-shaped bridge (e.g. 21B) arranged to surround and mate with the companion central dome and with the surrounding companion endless panel border.

Each structural rib section 182, 184 included in side wall 18 has been programmed using, for example, bands of material having wall thicknesses in accordance with the present disclosure and as shown, for example, in FIG. 4, to rigidify portions of the side wall 18 above and below the pop-panel section 183. Structural rib sections 182, 184 cooperate with the section 183 located between structural rib sections 182, 184 to maintain a round shape of the side wall 18 of container without significant distortion while allowing the six elastic pop panels 21-26 to flex in radially inward and outward directions during hot fill and subsequent cooling activity. It is within the scope of the present disclosure to vary the number, size, shape, and configuration of the pop panels.

A multilayer blow-molded container 12 is manufactured in accordance with the present disclosure using a base resin of polypropylene. Container 12 is made to be hot-filled with a liquid having a temperature in excess of 190° F. without paneling or distortion. A series of elastic pop panels 21-26 are formed and supported on a frame 20 and included in a side wall 18 to move in radially inward directions contract) in response to a vacuum in interior product-storage region 19 that develops during hot-fill activity and in radially outward directions in response to exposure to cool temperatures during subsequent cooling. Structural ribs 182, 184 are arranged to locate the elastic pop panels 21-26 therebetween to help maintain hoop strength and minimize out-of-round distortion. Providing relatively thicker bands of material in the structural ribs 182, 184 and relatively thinned out material in the elastic pop panels 21-26 to enhance flexibility of the pop panels 21-26 cooperate to provide means for returning side wall 18 of container 12 from a temporary radially inwardly drawn (contracted) condition shown, for example, in FIGS. 2 and 2A to a round (pre-contraction) condition after hot-fill and cooling activities have been completed as suggested in FIGS. 3 and 3A.

An illustrative container hot-fill and cooling sequence is shown in FIGS. 1-3. A tray 30 carrying four containers 12 made in accordance with the present disclosure is traveling on a moving conveyor 32 in a direction 34 past a hot-fill dispenser 36 and toward a cooling tunnel 38 as shown, for example, in FIG. 1. Hot-fill dispenser 36 is configured to provide means for discharging a hot liquid or other fluid into an interior product-storage region 19 formed in each container 12 before tray 30 passes into the downstream cooling tunnel 38. As suggested in FIG. 1, each unfilled (and unlidded) container 12 is maintained at room temperature as indicated diagrammatically by a thermometer 40 and interior product-storage region 19 is maintained at atmospheric (atm) pressure as indicated diagrammatically by a gauge 42 and characterized by an initial volume as indicated diagrammatically by a beaker 44. A normal round cross-sectional shape of a portion of the third side-wall section 183 of side wall 18 of container 12 is shown in FIG. 1A when container 12 is maintained at room temperature and there is no vacuum condition present in interior product-storage region 19 of container 12.

As suggested in FIG. 2, the leading two containers 12 on the moving tray 30 have been filled with hot liquid or other fluid. The hot liquid has caused a vacuum to be developed in interior product-storage region 19 of container as indicated diagrammatically by gauge 42. Such a vacuum condition extant in interior product-storage region 19 of container 12 operates to apply a suction force (F) to the interior surface of side wall 18 and notably to the interior surface of each elastic pop panel 21-26 as suggested in FIG. 2A to cause each elastic pop panel 21-26 to contract from a pre-contraction shape shown in FIGS. 1 and 1A in radially inward directions toward a vertical central axis 12A of container 12 to a contracted shape shown in FIGS. 2 and 2A to decrease the volume of interior product-storage region 19 of container 12 as indicated diagrammatically by beaker 44 (see FIG. 2) without damaging side wall 18 of container 12. A temporary OUT-OF-ROUND cross-sectional shape of a portion of the third side-wall section 183 of side wall 18 of container 12 is shown in FIG. 2A when container 12 is but owing to being filled with a hot liquid or other fluid and exposed to a vacuum condition in interior product-storage region 19 of container 12.

As suggested in FIG. 3, containers 12 have now passed through cooling tunnel 38 to dissipate any vacuum extant in interior product-storage region 19 of container 12. Each elastic pop panel 21-26 has expanded owing, in part, to the elasticity of the material used to form side wall 18, to assume its original pre-contraction shape shown in FIGS. 1 and 1A now that container 12 was cooled in cooling tunnel 38 and the pressure and volume of interior product-storage region 19 have returned to normal. A normal round cross-sectional shape of a portion of side wall 18 of container 12 is thus re-established as shown in FIG. 3A.

Figure 11:
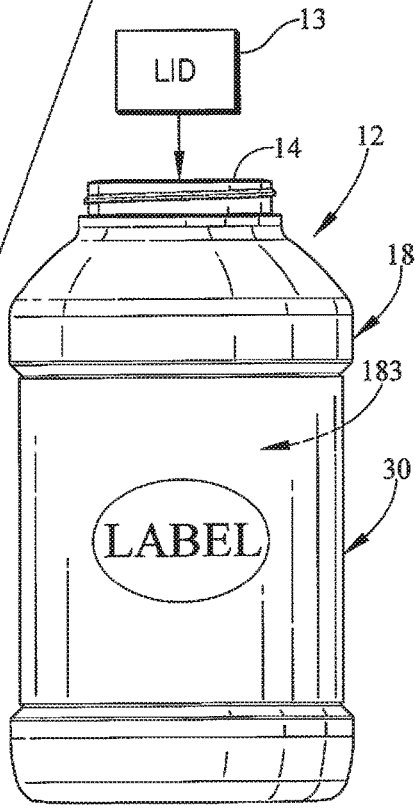
FIG. 11 is a view similar to FIG. 10 after the pliable sheet has been mounted on the side wall of the container to provide a label.

A label 30 is applied to side wall 18 of container 12 in a manner suggested in FIG. 10. Once mounted in place, label 30 convers pop-panel or label section 183 of side wall 18 as suggested in FIG. 11 in illustrative embodiments of the present disclosure. It is within the scope of the present disclosure to omit the elastic pop panels in an illustrative embodiment. Label 30 has a height 301 of about 4.274 inches in an illustrative embodiment.

Container 12 is blow-molded using, for example, a polypropylene material. Side wall 18 comprises a variable wall thickness and a pop-panel section 183 interposed between structural rib sections 182, 184. Pop-panels 21-26 in pop-panel section 183 suck in during hot fill and then relax during cooling. The structural support area of side wall 18 provided by structural ribs 182, 184 is thicker than the label area of side wall 18 provided by pop-panel section 183. The wall thickness may vary from container to container but the structural ribs will be thicker than the label area.

A package 10 comprises a container 12 having a brim 14, a floor 16, and a side wall 18 arranged to interconnect the brim 14 and the floor 16 as suggested in FIGS. 1 and 4. Brim 14 is adapted to mate with a lid 13 to close an opening into an interior product-storage region 19 bounded by the floor 16 and side wall 18 as suggested in FIG. 10.

Figure 6:
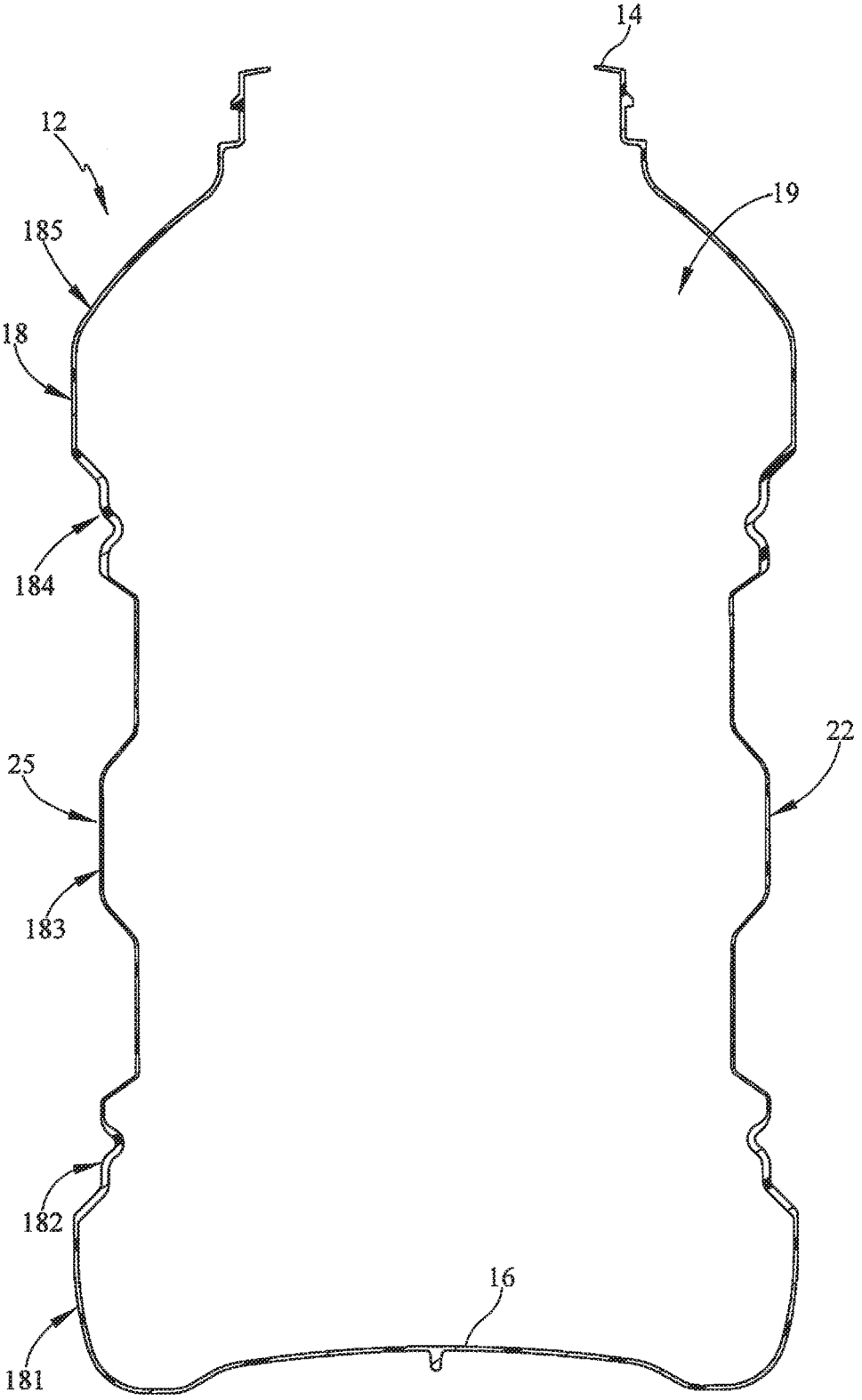
FIG. 6 is a dead-section view taken along line 6-6 of FIG. 5.
Figure 7:
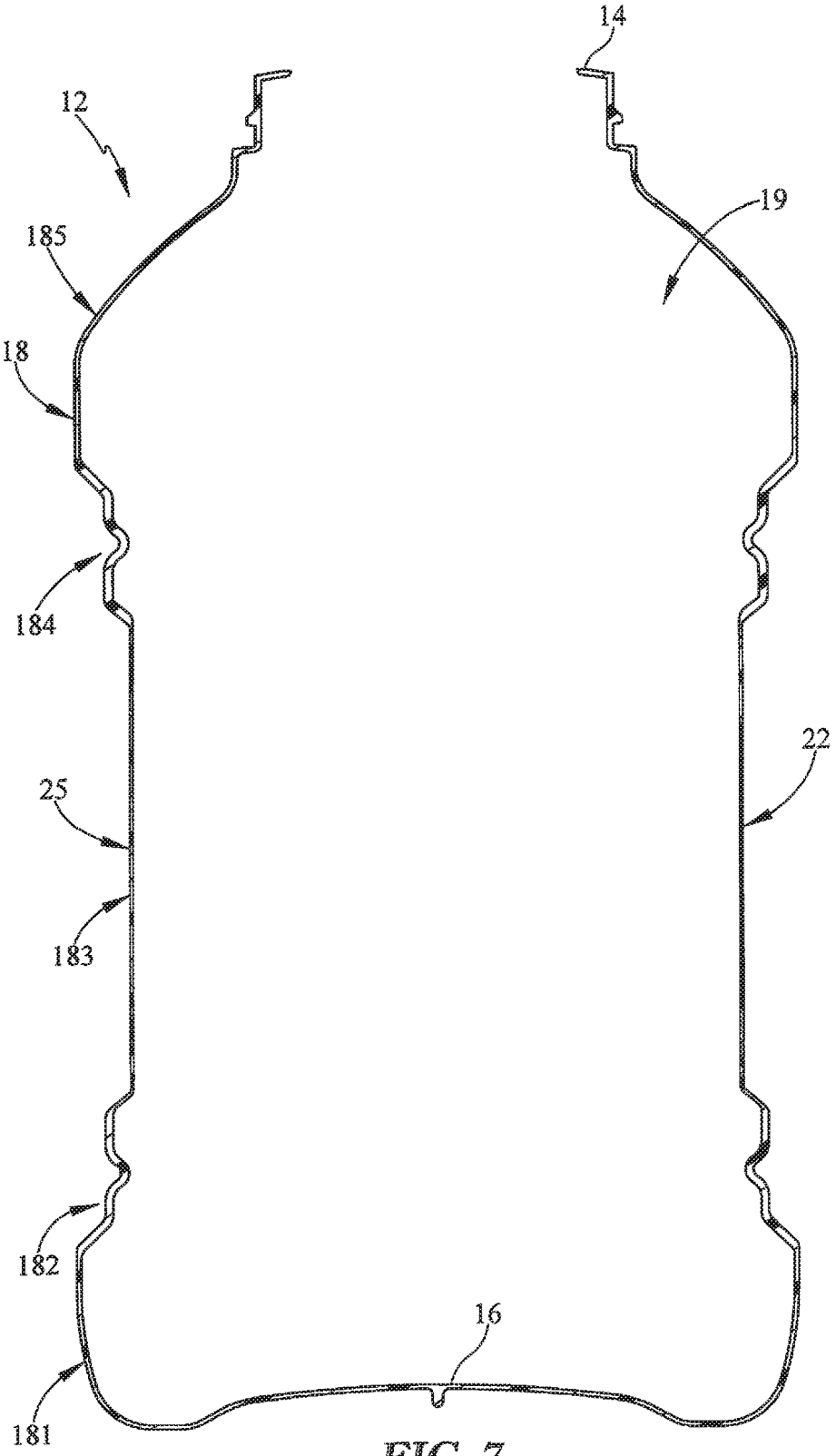
FIG. 7 is a dead-section view taken along line 7-7 of FIG. 5.
Figure 8:
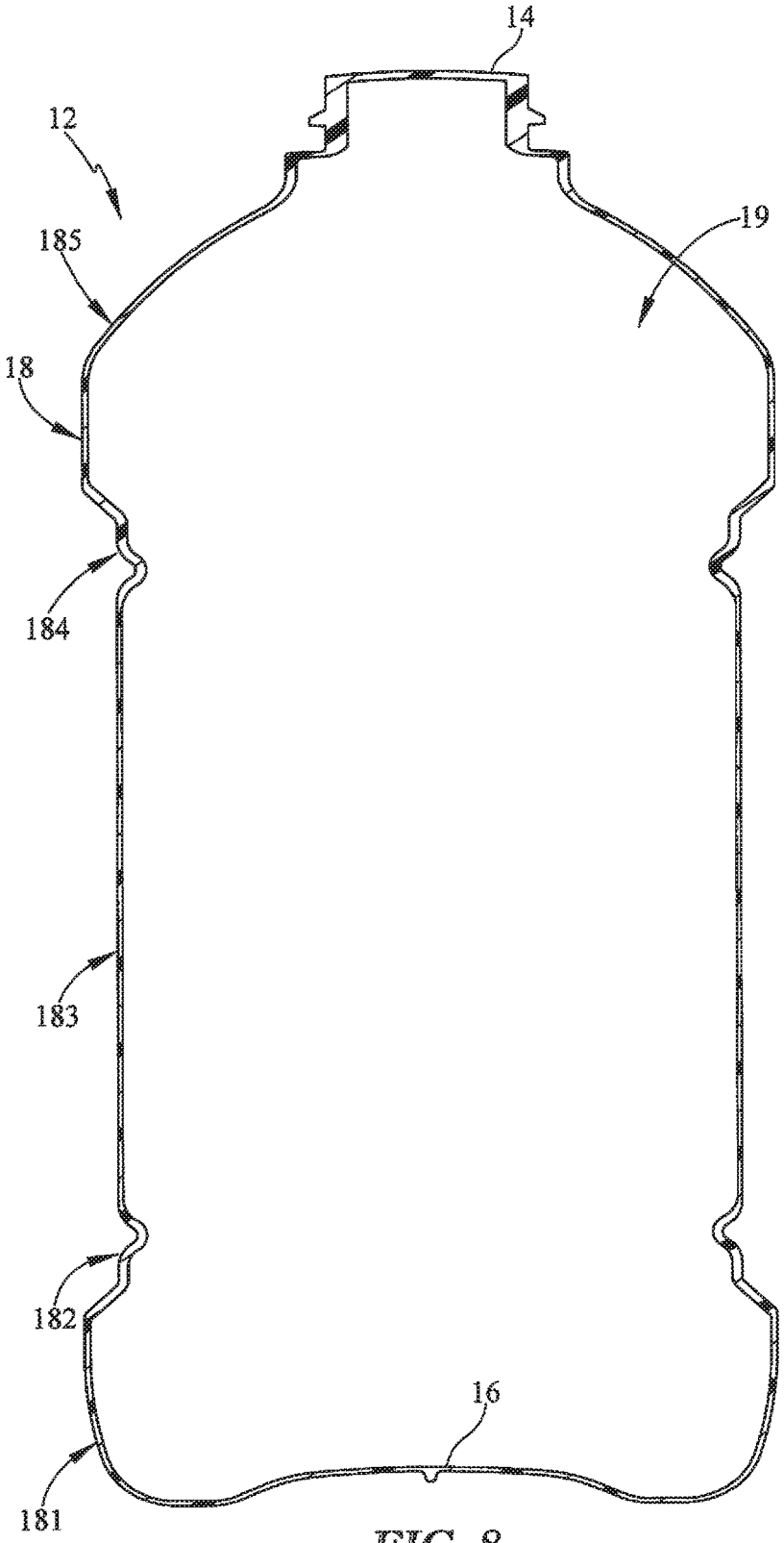
FIG. 8 is a dead-section view taken along line 8-8 of FIG. 5.

Side wall 18 includes, in series, abase section 181 associated with the floor 16, a first structural rib section 182, a middle section 183, a second structural rib section 184, and a canopy section 185 associated with the brim 14 as suggested in FIGS. 4 and 6. Base section 181 defines a first side-wall zone 100 characterized by a first wall thickness. First structural rib section 182 defines a second side-wall zone 200 characterized by a second wall thickness that is greater than the first wall thickness. Middle section 183 defines a third side-wall zone 300 characterized by a wall thickness that is less than the first wall thickness. Second structural rib section 184 defines a fourth side-wall zone 400 characterized by a fourth wall thickness that is greater than the second wall thickness. Canopy section 185 defines a fifth side-wall zone 500 characterized by a fifth wall thickness that is about equal to the first wall thickness.

In illustrative embodiments, the first wall thickness is about 0.025 inches, the second wall thickness is about 0.045 inches, the fourth wall thickness is about 0.050 inches, and the third wall thickness is about 0.015 inches. Each of the first and second structural ribs comprises bands of material as suggested in FIG. 4.

Package 10 also includes a label 30 arranged to surround an exterior surface of the middle section 183 as suggested in FIG. 10. Label 30 is arranged to overlie portions of the first and second structural ribs 182, 184 as suggested in FIG. 11.

The middle section 183, in illustrative embodiments is a pop-panel section that includes a frame 20 and at least one elastic pop panel 21-26 as suggested in FIGS. 1 and 1A. Frame 20 is arranged to interconnect the first and second structural ribs 182, 184 and at least one elastic pop panel 21-26 that is supported on frame 20 for movement in a radially inward direction toward a vertical central axis 12A of the container 12 from an initial pre-contraction shape suggested in FIG. 1A to a temporary hot-fill contracted shape suggested in FIG. 2A in response to exposure of an interior surface of side wall 18 to a suction force (F) generated by a vacuum in the interior product-storage region 19 that develops during a hot-fill activity in which a hot fluid is introduced by a hot-fill dispenser 36 into the interior product-storage region 19 to decrease the volume of the interior product-storage region 19 without damaging the side wall 18 of the container 12. Side wall 18 has a variable wall thickness, in illustrative embodiments of the present disclosure.

Frame 20 is formed to include six circumferentially spaced-apart, oblong, endless panel borders as suggested in FIGS. 1, 1A, and 4. Each elastic pop panel 21-26 is coupled to one of the endless panel borders included in the frame 20 to fill space bounded by the one of the endless panel borders to provide a monolithic third side-wall zone 300.

Each elastic pop panel 21-26 comprises a central dome (e.g., 21D) and a ring-shaped bridge (e.g., 21B). Each ring-shaped bridge is arranged to surround and mate with a companion central dome and with a portion of the endless panel border surrounding the ring-shaped bridge.

In illustrative embodiments, the second wall thickness is about 0.045 inches and the fourth wall thickness is about 0.050 inches to maintain hoop strength of the first and second structural ribs 182, 184 during exposure of the elastic pop panels 21-26 to a vacuum in the interior product-storage region 19 produced by a hot-fill liquid in the interior product-storage region 19 and resultant movement of each of the elastic pop panels 21-26 relative to frame 20 from a pre-contraction shape in the radially inward direction toward the vertical central axis 12A to assume a contracted shape.

Each of the first and second structural ribs 182, 184 has an annular shape as suggested in FIG. 4. Frame 20 has an annular shape as suggested in FIG. 4. The third wall thickness is about 0.015 inches to maximize pliability and flexibility of the elastic pop panels 21-26. The second wall thickness is about 0.045 inches and the fourth wall thickness is about 0.050 inches to minimize out-of-round distortion of the side wall 18 during flexure of the elastic pop panels 21-26 relative to frame 20 when exposed to a vacuum in the interior product-storage region 19.

The invention claimed is:

1. A package comprising a container having a brim, a floor, and a side wall arranged to interconnect the brim and the floor, the brim being adapted to mate with a lid to close an opening into an interior product-storage region bounded by the floor and side wall, wherein the side wall includes, in series, a base section associated with the floor, a first structural rib section, a pop-panel section, a second structural rib section, and a canopy section associated with the brim, the pop-panel section includes a frame arranged to interconnect the first and second structural ribs and at least one elastic pop panel supported on the frame for movement in a radially inward direction toward a vertical central axis of the container from an initial pre-contraction shape to a temporary hot-fill contracted shape in response to a vacuum in the interior product-storage region that develops during a hot-fill activity in which a hot fluid is introduced into the interior product-storage region to decrease the volume of the interior product-storage region without damaging the side wall of the container, the side wall has a variable wall thickness, the base section defines a first side-wall zone characterized by a first wall thickness, the first structural rib section defines a second side-wall zone characterized by a second wall thickness that is greater than the first wall thickness, the pop-panel section defines a third side-wall zone characterized by a wall thickness that is less than the first wall thickness, the second structural rib section defines a fourth side-wall zone characterized by a fourth wall thickness that is greater than the second wall thickness.

2. The package of claim 1, wherein the canopy section defines a fifth side-wall zone characterized by a fifth wall thickness that is about equal to the first wall thickness.

3. The package of claim 1, wherein the first wall thickness is about 0.025 inches, the second wall thickness is about 0.045 inches, the fourth wall thickness is about 0.050 inches, and the third wall thickness is about 0.015 inches.

4. The package of claim 3, wherein the canopy section defines a fifth side-wall zone characterized by a fifth wall thickness that is about equal to the first wall thickness.

5. The package of claim 1, wherein the frame is formed to include six circumferentially spaced-apart, oblong, endless panel borders, each elastic pop panel is coupled to one of the endless panel borders included in the frame to fill space bounded by the one of the endless panel borders to provide a monolithic third side-wall zone and the third wall thickness is about 0.015 inches.

6. The package of claim 5, wherein each elastic pop panel comprises a central dome and a ring-shaped bridge arranged to surround and mate with a companion central dome and with a portion of the endless panel border surrounding the ring-shaped bridge.

7. The package of claim 6, wherein the second wall thickness is about 0.045 inches and the fourth wall thickness is about 0.050 inches to maintain hoop strength of the first and second structural ribs during exposure of the elastic pop panels to a vacuum in the interior product-storage region produced by a hot-fill liquid in the interior product-storage region and resultant movement of each of the elastic pop panels relative to the frame from a pre-contraction shape in the radially inward direction toward the vertical central axis to assume a contracted shape.

8. The package of claim 1, wherein each of the first and second structural ribs has an annular shape, the frame has an annular shape, the third wall thickness is about 0.015 inches to maximize pliability and flexibility of the elastic pop panels, and the second wall thickness is about 0.045 inches and the fourth wall thickness is about 0.050 inches to minimize out-of-round distortion of the side wall during flexure of the elastic pop panels relative to the frame when exposed to a vacuum in the interior product-storage region.

9. A package comprising a container having a brim, a floor, and a side wall arranged to interconnect the brim and the floor, the brim being adapted to mate with a lid to close an opening into an interior product-storage region bounded by the floor and side wall, wherein the side wall includes, in series, a base section associated with the floor, a first structural rib section, a middle section, a second structural rib section, and a canopy section associated with the brim, the base section defines a first side-wall zone characterized by a first wall thickness, the first structural rib section defines a second side-wall zone characterized by a second wall thickness that is greater than the first wall thickness, the middle section defines a third side-wall zone characterized by a wall thickness that is less than the first wall thickness, the second structural rib section defines a fourth side-wall zone characterized by a fourth wall thickness that is greater than the second wall thickness.

10. The package of claim 9, wherein the first wall thickness is about 0.025 inches, the second wall thickness is about 0.045 inches, the fourth wall thickness is about 0.050 inches, and the third wall thickness is about 0.015 inches.

11. The package of claim 10, wherein the canopy section defines a fifth side-wall zone characterized by a fifth wall thickness that is about equal to the first wall thickness.

12. The package of claim 9, wherein the canopy section defines a fifth side-wall zone characterized by a fifth wall thickness that is about equal to the first wall thickness.

13. The package of claim 9, wherein each of the first and second structural ribs comprises bands of material.

14. The package of claim 9, further comprising a label arranged to surround an exterior surface of the middle section and overlie portions of the first and second structural ribs.

* * * * *